United States Patent [19]

Russell, Jr.

[11] 4,260,350

[45] Apr. 7, 1981

[54] FILTER FOR HIGH VISCOSITY LIQUIDS

[75] Inventor: Luther O. Russell, Jr., Gastonia, N.C.

[73] Assignee: Fiber Industries, Inc., New York, N.Y.

[21] Appl. No.: 140,648

[22] Filed: Apr. 16, 1980

Related U.S. Application Data

[63] Continuation of Ser. No. 920,611, Jun. 29, 1978, abandoned.

[51] Int. Cl.[3] ..... B29F 3/06

[52] U.S. Cl. ..... 425/197; 264/176 F; 425/198

[58] Field of Search ..... 264/176 F; 425/197–198

[56] References Cited

U.S. PATENT DOCUMENTS

| | | | |
|---|---|---|---|
| 2,038,348 | 4/1936 | Cusin | 425/197 |
| 2,266,368 | 12/1941 | Hull et al. | 425/199 |
| 2,607,954 | 8/1952 | Schneider et al. | 264/176 R |
| 2,732,585 | 1/1956 | Wicker | 425/198 |
| 3,307,216 | 3/1967 | Dunn et al. | 425/198 |
| 3,469,279 | 9/1969 | Hudgell | 425/198 |
| 3,475,527 | 10/1969 | Chapman | 425/198 |
| 3,724,064 | 4/1973 | Mott | 425/464 |
| 3,771,664 | 11/1973 | Schriak et al. | 210/448 |
| 3,797,982 | 3/1974 | Borrello | 425/198 |

FOREIGN PATENT DOCUMENTS

| | | | |
|---|---|---|---|
| 53-8811 | 4/1978 | Japan | 264/176 F |

*Primary Examiner*—Jay H. Woo

*Attorney, Agent, or Firm*—Roderick B. Macleod

[57] ABSTRACT

An improved replaceable filtration unit for high viscosity fluids, of the self sealing semi-disposable type and having inert granular material supported by a screen within a housing, wherein the improvement comprises having the screen's rim swaged into the housing, preferably with an interference fit within the range 0.005 to 0.015 inches. The invention improves the performance of packs used to filter and extrude molten polymer into shaped articles.

15 Claims, 7 Drawing Figures

Fig. 2
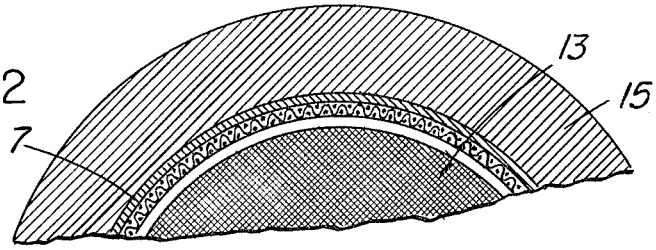
Fig.3
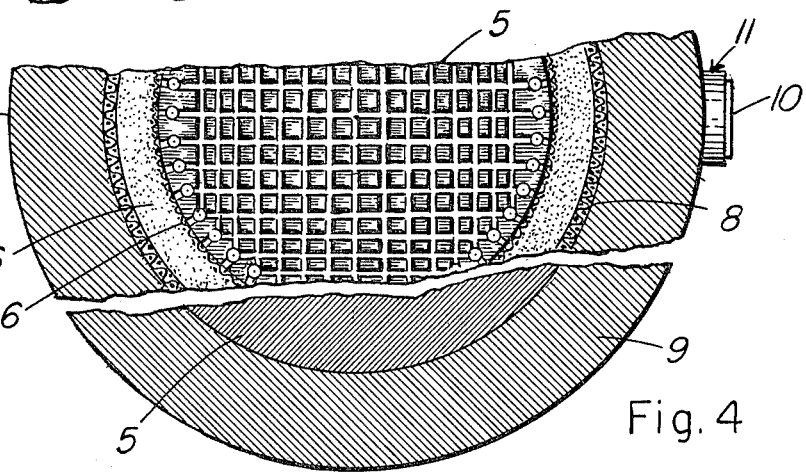
Fig. 4
Fig. 1
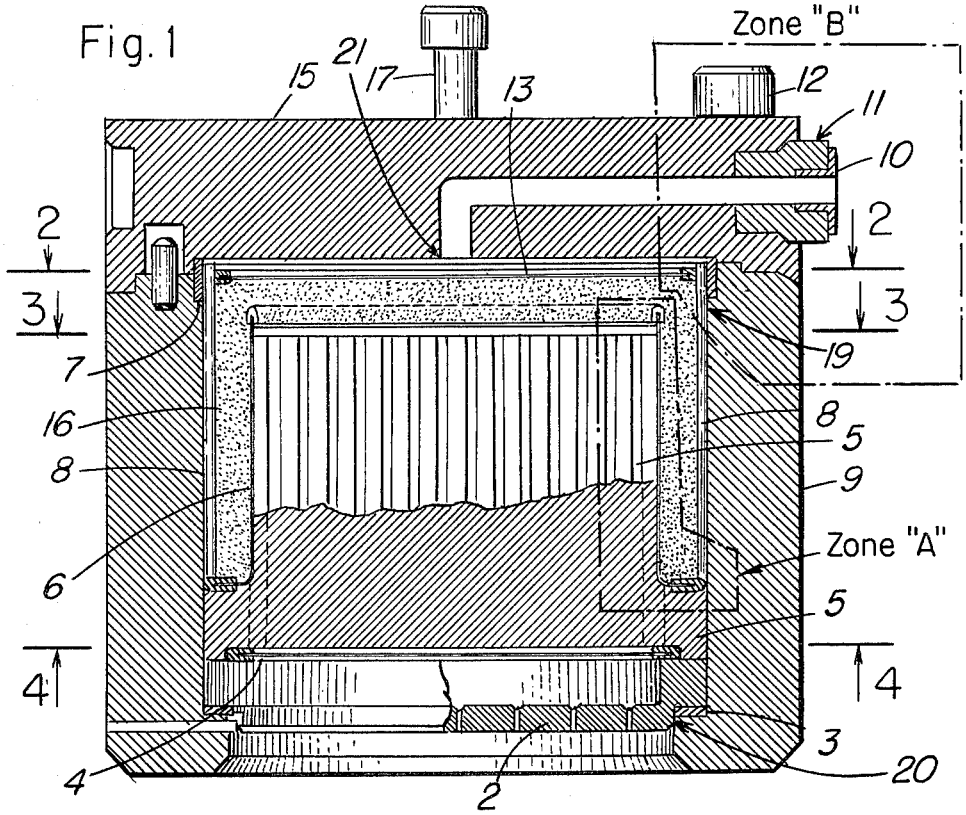

FILTER FOR HIGH VISCOSITY LIQUIDS

This is a continuation of application Ser. No. 920,611, filed June 29, 1978, now abandoned.

BACKGROUND OF THE INVENTION (i) Field of the Invention

The invention relates broadly to the filtration of fluids. More particularly, it relates to seals in replaceable packs for filtering highly pressurized high viscosity molten polymer and extruding the filtered polymer into shaped articles such as filaments and films.

(ii) Prior Art

Packs for filtering pressurized high viscosity polymeric material and forming the filtered liquid into spun filaments are well known in the art. A pack of relatively recent design and its mode of operation is disclosed in U.S. Pat. No. 3,307,216. Typically, all such packs are assembled from a mixture of re-useable components (such as housing, lid, spinnerette) and disposable components (such as inert granular material, gaskets, and screens for supporting the inert granular material). The average time interval between replacing packs has a significant effect on both the economics of the process and the quality of the product.

SUMMARY OF THE INVENTION

The invention arose out of the discovery that the type of pack disclosed in the forementioned U.S. Pat. No. 3,307,216 had certain drawbacks, particularly for the spinning of highly viscous material at high throughputs. In particular, it was found that some of the seals for controlling polymer flow were not consistently effective, resulting in both external polymer leaks out of the pack, and internal polymer leaks (or by-passing) within the pack. Both types of leak are highly undesirable.

It has now been found that the claimed invention, in which the rim of the screen supporting the inert granular material is swaged into the housing, significantly reduces the number of these highly undesirable leaks, and in addition halves the time to assembly the pack components into an integral unit. The improved seal design may be used with advantage in any replaceable filter of the type described regardless of whether the filter is integrally combined with an extrusion die. The improved seal designs are extremely valuable in melt spinning packs designed for use in combination with already constructed apparatus that imposes severe space limitations. The invention is surprising, particularly since the type of seal shown in U.S. Pat. No. 3,307,216 has been used commercially for over ten years in the manufacture of many billions of pounds of fiber.

BRIEF DESCRIPTION OF THE DRAWINGS

FIG. 1 is a vertical cross section of an assembled melt spinning pack of the invention.

FIGS. 2, 3 AND 4 are horizontal fragmentary cross sections along lines 2—2, 3—3 and 4—4 respectively of FIG. 1.

DESCRIPTION OF THE PREFERRED EMBODIMENTS

Figure 5:
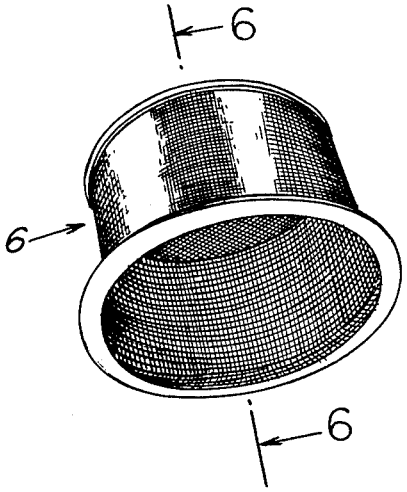
FIG. 5 is a perspective view of an unassembled "top hat" screen and corresponds to item 6 of FIG. 1 in assembled form.

The Figures illustrate the preferred embodiments of the invention.

FIG. 1 is a vertical cross section of an assembled melt spinning pack incorporating the invention. In particular, FIG. 1 shows an improved replaceable pack for filtering pressurized high viscosity molten polymer and extruding the filtered polymer into shaped articles such as filaments and films, which pack comprises a housing (9) having an inlet port (19) and an outlet port (20), a lid (15) having an inlet port (11) and an exit port (21) and the lid being rigidly connected via a first gasket (7) to the housing around the lid's exit port and around the housing's inlet port, an extrusion die (2) rigidly connected via a second gasket (3) around the housing's outlet port, an internal lip (5) within the housing between the extrusion die and the inlet port of the housing, means for filtering the fluid immediately upstream of the lip, which filtering means comprises inert granular material (16) immediately upstream of a supporting rimmed fine mesh screen (6) whose annular rim contacts the housing's internal lip (5), wherein the improvement comprises: said screen's rim is swaged into said housing, whereby there is a reduced chance of some of said fluid and said granular material by-passing said screen. Likewise, FIG. 1 also illustrates an improved replaceable filtration unit for high viscosity fluids, which filter unit comprises a housing (9) having an inlet port (19) and an exit port (20), a rimmed fine mesh screen (6) between the ports for filtering the fluid, wherein the improvement comprises: said screen's rim is swaged into said housing.

Figure 6:
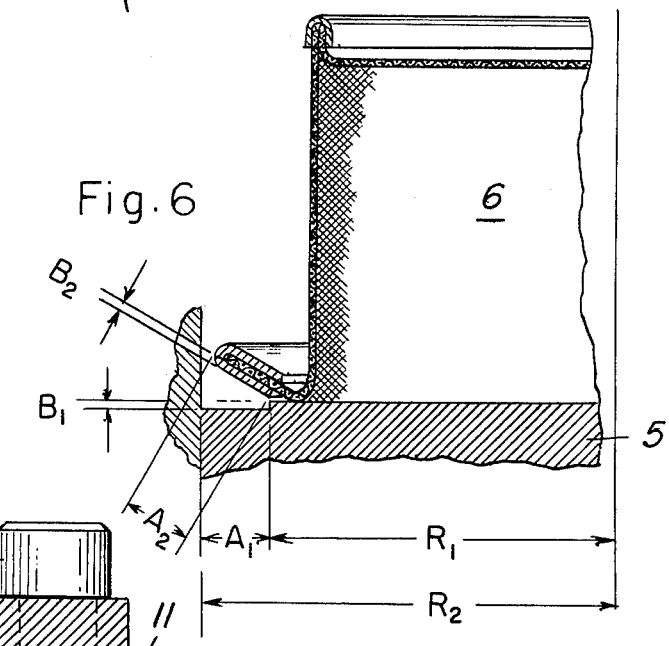
FIG. 6 is an enlarged view of Zone A of FIG. 1, as it looks during assembly of the pack prior to the swaging operation.

FIG. 6 is an enlargement of Zone "A" prior to swaging of the rim of screen (6) into both the housing (9) and a grooved bridge plate (5). The screen is in the shape of a top hat and at least partly annular. It is preferred that the total radial interference fit imposed upon the rim of the screen be between 0.005 and 0.015 inches. Thus, in FIG. 6, the dimension $A_2$ is greater than dimension $A_1$, by an amount within the range of about 0.005 to 0.015 inches. Also, the dimension $B_2$ is preferably greater than the dimension $B_1$ by an amount up to 0.002 inches. It will, of course, be appreciated by one skilled in the art, that swaging of the unswaged rim of the screen as shown in FIG. 6 (and having the relative dimensions of A, $A_2$, $B_1$ and $B_2$ as defined above) into the swaged rim as shown in FIG. 1, Zone A, must inherently result in the rim being outwardly swaged and toggle jointed into the housing. Webster's New Collegiate Dictionary (1961) defines toggle joint as "(a) device consisting of two bars jointed together end to end but not in line, so that when a force is applied to the knee tending to straighten the arrangement, the parts abutting . . . the ends of the bars will experience an endways pressure."

Figure 7:
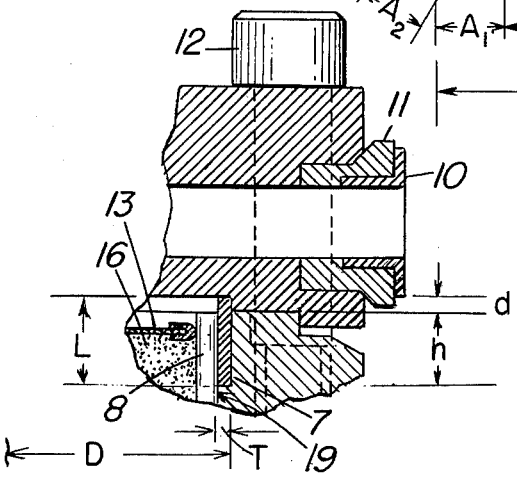
FIG. 7 is an enlarged view of Zone B of FIG. 1.

FIG. 7 is an enlargement of Zone B of FIG. 1, and shows the seal between the pack housing and lid. It shows a first gasket (7) in the form of a metal sleeve having a length, L, outer diameter, D, and wall thickness, T; and the housing's inlet port (19) has a square step around its inner face. The square step has a radial depth of about T and a height h. The value of h must be less than the value of L. It is preferred that the value of L/T be in the range 2 to 10, and most preferably in the range 4 to 7. It is preferred that T be in the range from 0.025 to 0.100 inches. The metal sleeve is preferably aluminum, copper, mild steel or stainless steel. It is preferred that the inside face of the lid has a counter bore of diameter D and depth d, and the value of the sum of h and d is equal to L in the assembled state and less than L in the unassembled state.

It is preferred that the third and remaining seal with the pack, the seal between the extrusion die (2) and the housing's outlet port (20) be obtained conventionally as shown in FIG. 1, which shows the housing (9) having a second lip around its exit port (20) that is rigidly connected to the extrusion die via a second gasket (3) by means of the pressure of the pressurized fluid within the pack.

while the foregoing, in combination with the drawings, illustrates the broadest and most preferred embodiments of the invention, it will of course be appreciated that other embodiments of the invention come within the scope of the broadest claims.

What I claim is:

1. An improved replaceable pack for filtering pressurized high viscosity molten polymer and extruding the filtered polymer into shaped articles such as filaments and films, which pack comprises a housing having an inlet port and an outlet port, a lid having an inlet port and the lid being rigidly connected via a first gasket to the housing around the housing's inlet port, an extrusion die rigidly connected via a second gasket around the housing's outlet port, an internal lip within the housing between the extrusion die and the inlet port of the housing, means for filtering the fluid immediately upstream of the lip, which filtering means comprises inert granular material immediately upstream of a supporting rimmed fine mesh screen whose annular rim contacts the housing's internal lip, wherein the improvement comprises:

said screen's rim is outwardly swaged and toggle jointed into said housing, whereby there is a reduced chance of some of said fluid and said granular material by-passing said screen.

2. The pack of claim 1 wherein said swaged rim has an interference fit within the range 0.005 to 0.015 inches.

3. The pack of claim 2 wherein said screen is at least partly annular in shape.

4. The pack of claim 2 which further comprises a grooved bridge plate downstream of said screen and wherein said screen is in the shape of a top hat, and said rim's inner surface is swaged into said bridge plate.

5. The pack of claim 2 wherein said first gasket is a metal sleeve having a length, L, outer diameter, D, and wall thickness T; and said housing's inlet port has a square step around said inlet port's inner face, said step having a radial depth of about T and a height, h, and the value of h is less than L, and the value of L/T is in the range of 2 to 10, whereby the chance of fluid leakage at the lid is reduced.

6. The pack of claim 5 wherein said lid has a counter bore of diameter about D and depth d, and the value of the sum of h and d is less than L in the unassembled state and equal to L in the assembled state.

7. The pack of claim 5, wherein L/T is in the range of 4 to 7.

8. The pack of claim 7, wherein T is in the range of 0.025 to 0.100 inches.

9. The pack of claim 8, wherein said metal sleeve comprises aluminum, copper, mild steel or stainless steel.

10. The pack of claim 2 wherein said housing has a second lip around said housing's exit port, and said extrusion die is rigidly connected to said second lip via a second gasket by pressure of said pressurized fluid.

11. An improved replaceable filtration unit for high viscosity fluids, which filter unit comprises a housing having an inlet port and an exit port, a rimmed fine mesh screen between the ports for filtering the fluid, wherein the improvement comprises:

said screen's rim is swaged into said housing.

12. The pack of claim 1 wherein said screen's rim has an uncorrugated shape prior to being swaged.

13. The pack of claim 1 wherein said screen's rim is changed from a frustoconical shape to a planar shape during swaging.

14. The pack of claim 12 wherein said swaged rim has an interference fit within the range 0.005 to 0.015 inches.

15. The pack of claim 13 wherein said swaged rim has an interference fit within the range 0.005 to 0.015 inches.

* * * * *